US008955356B1

(12) United States Patent
Smith

(10) Patent No.: US 8,955,356 B1
(45) Date of Patent: Feb. 17, 2015

(54) INTERCHANGEABLE JEWELRY DEVICE

(71) Applicant: Jennifer Smith, Cedar Rapids, IA (US)

(72) Inventor: Jennifer Smith, Cedar Rapids, IA (US)

( * ) Notice: Subject to any disclaimer, the term of this patent is extended or adjusted under 35 U.S.C. 154(b) by 0 days.

(21) Appl. No.: 13/925,026

(22) Filed: Jun. 24, 2013

(51) Int. Cl.
*A44C 25/00* (2006.01)

(52) U.S. Cl.
CPC ..... *A44C 25/001* (2013.01); *Y10S 63/90* (2013.01)
USPC ..... 63/40; 63/900; 24/303

(58) Field of Classification Search
CPC .. A44D 2203/00; A44C 13/00; A44C 25/001; A44C 25/002; A44C 25/007
USPC ..... 63/18, 23, 35, 40, 900, 29.2, 19; 24/303, 574.1, 578.1, 578.11
See application file for complete search history.

(56) References Cited

U.S. PATENT DOCUMENTS 316,118 A * 4/1885 Cooke et al. ..... 63/18
4,021,891 A * 5/1977 Morita ..... 24/303
4,989,299 A * 2/1991 Morita ..... 24/303
5,611,120 A * 3/1997 Riceman et al. ..... 24/303
7,073,232 B1 * 7/2006 Fuhrman et al. ..... 24/303
8,371,141 B2 * 2/2013 Richmond ..... 63/29.2
2005/0278903 A1 * 12/2005 Dunaye ..... 24/303
2010/0257897 A1 * 10/2010 Kohl ..... 63/1.14
2010/0257898 A1 * 10/2010 Bonilla ..... 63/3.1
2012/0291227 A1 * 11/2012 Fiedler ..... 24/3.3

FOREIGN PATENT DOCUMENTS

CH 700663 A1 * 9/2010
EP 1810587 A1 * 7/2007

* cited by examiner

*Primary Examiner* — Jack W Lavinder
*Assistant Examiner* — Abigail Morrell
(74) *Attorney, Agent, or Firm* — Brett D. Papendick; Shuttleworth & Ingersoll, PLC

(57) ABSTRACT

An interchangeable jewelry device which allows a user to display a variety of decorative elements on a bail member. The device has a middle bail member or coupling member which can be hung on a typical necklace, bracelet, or another item which utilizes a chain or ring. A pair of decorative elements is attached to two bodies and is positioned on opposite sides of the coupling member. A pair of magnets on the first body is attracted to the magnets of the second body which then maintain the position of the decorative elements.

16 Claims, 6 Drawing Sheets

INTERCHANGEABLE JEWELRY DEVICE

BACKGROUND

A typical piece of jewelry, particularly a necklace has a chain with some type of charm or decorative element attached to it. In order to change the aesthetics of the jewelry, a user must purchase a new chain with a different charm or decorative element. Accordingly, the user expends considerable funds to have a variety of jewelry pieces.

It is an object of the invention to provide a user with one base piece of jewelry that can have multiple decorative elements.

It is a further object of the invention to provide a user with the ability to easily change the decorative elements.

SUMMARY OF THE INVENTION

The interchangeable jewelry device has a bail or coupling member which is positioned between a pair of decorative elements. The coupling member has at least one loop which allows a typical chain of a necklace or some other type of jewelry. The coupling member also has at least one opening.

The preferred embodiment has a first body and a second body which are on opposite sides of the coupling member. The first body and the second body preferably have a pair of magnets. The magnets of the first body are attracted to the magnets of the second body. The first body and the second body each also have a decorative element. The decorative element is opposite of the magnets.

The first and second bodies are positioned on opposite sides of the coupling member such that the magnets are partially contained in the openings. The attraction of the magnets maintains the position of the coupling member, first body and second body while the device is being worn. The decorative elements face outward during wear.

A different first or second body with a different decorative element can be switched with the original decorative element. Therefore, a user can easily change the decorative element while maintaining the same coupling member and associated chain.

DETAILED DESCRIPTION

Figure 1:
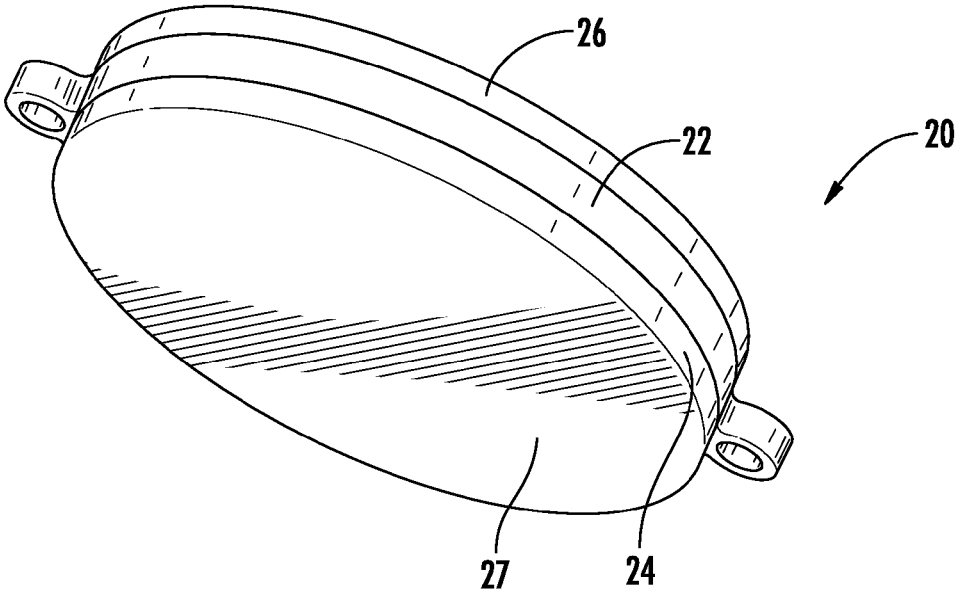
FIG. 1 is a perspective view of a first embodiment of the invention.

Now referring to the drawings, FIGS. 1-4 show an interchangeable jewelry device 20 comprising a coupling member 22, a first body 24, and a second body 26. The coupling member 22 is positioned between the first body 24 and the second body 26.

Figure 2:
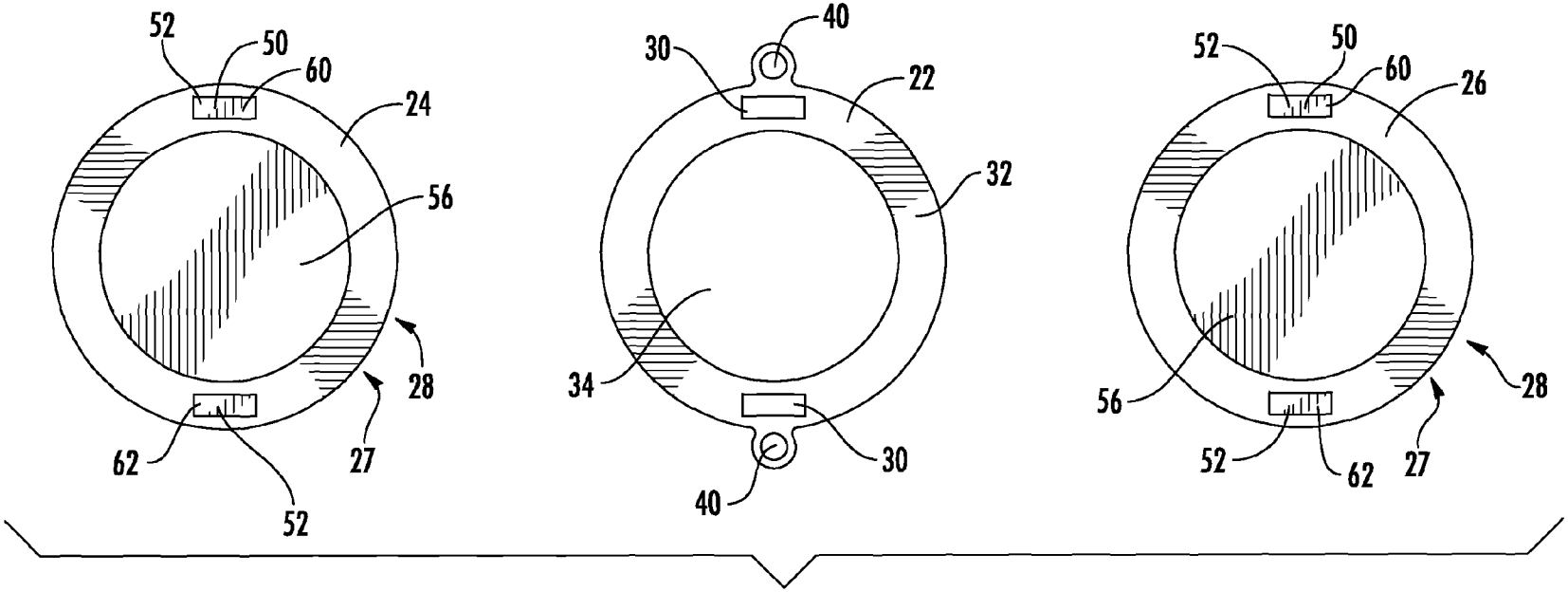
FIG. 2 is an exploded view of the invention.
Figure 3:
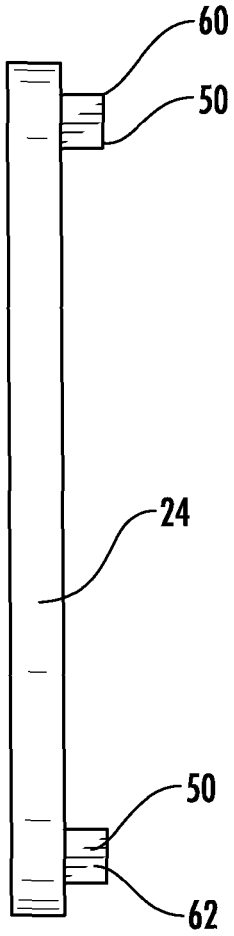
FIG. 3 is a side view of the first body.
Figure 4:
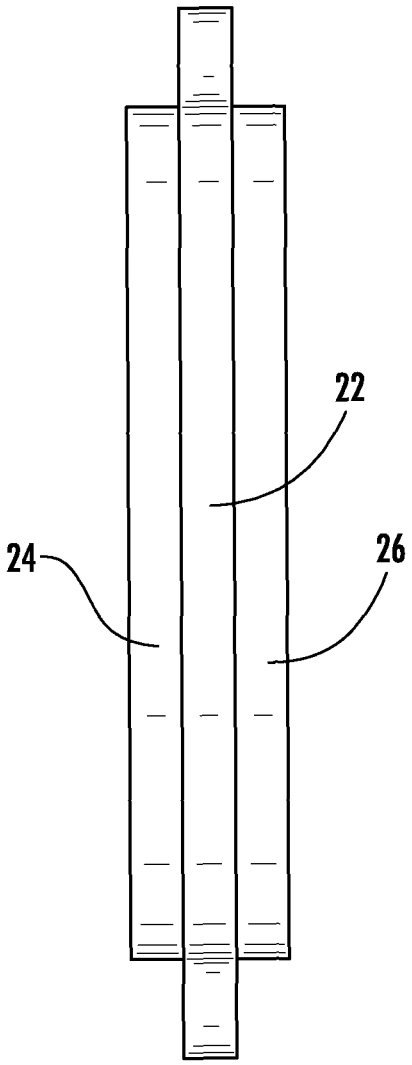
FIG. 4 is a side view of the first embodiment.

The coupling member 22 is shown in greater detail in FIG. 2. Although shown as a circular shape, the coupling member 22 and/or the bodies 24, 26 can be any shape. The coupling member 22 is a ring 32, preferably with a hollow center 34. The coupling member 22 further comprises at least one recess 30 and the preferred embodiment has two recesses 30. The recess 30 can extend the entire width of the coupling member 22, thus creating a passageway from a first side of the coupling member 22 to the second side of the coupling member 22, or the recess 30 can extend only partially through the width of the coupling member 22. At least one loop 40 is part of the coupling member 22 and can receive a chain of a standard necklace, bracelet, other piece of jewelry, or some other product using a chain or ring, such as a key chain.

The first body 24 and second body 26 are preferably identical, however, the first body 24 can have a different design face 27 than the design face 27 of the second body 26. Each body 24, 26 is preferably the same shape as the coupling member 22 and has a radius the same as a radius of the coupling member 22. The design face 27 is on a first side 28 of the first body 24, while a second side 56 of the first body 24 is void of any design (the same can be said for the second body 26). Each body 24, 26 has an attachment mechanism 50 which in the preferred embodiment are magnets 52. Each body 24, 26 has a first magnet 60 and a second magnet 62 in the preferred embodiment. The magnets 52 of the first body 24 are attracted to the magnets 52 of the second body 26.

The design face 27 of the first body 24 has a personalized design, logo or art. The design face 27 can be a separate piece which is connected permanently or selectively to the body 24 or the design face can be integrally formed as part of the body 24 during manufacturing. The design face 27 of the second body 26 can have the same characteristics as the first body 24. Alternatively, one of the bodies 24 or 26 could lack the design face 27.

In actual use, a first body 24 is set such that the magnets 60 and 62 of the first body 24 fit at least partially in the recesses 30 of the coupling member 22. The second body 26 is then placed on the opposite side of the coupling member 22 such that the magnets 60 and 62 of the second body 26 fit at least partially in the recesses 30 of the coupling member 22. The magnets 60, 62 of the first body 24 are attracted to the magnets 60, 62 respectively of the second body 26. A force generated by the attraction of the magnets 50 maintains the position of the coupling member 22, first body 24 and second body 26. Those positions have the coupling member 22 in between the first body 24 and the second body 26. The coupling member 22 can be sold with a chain (not shown) already within one or more of the loops 40 or a chain can be sold separately.

When worn by a user, one of the design faces 27 will face out and be visible to others. The design face 27 on either the first body 24 and/or second body 26 can easily be exchanged for another design face on another first body 24 or second body 26. Accordingly, a user could maintain a plurality of bodies 24, 26 which have different design faces.

Figure 5:
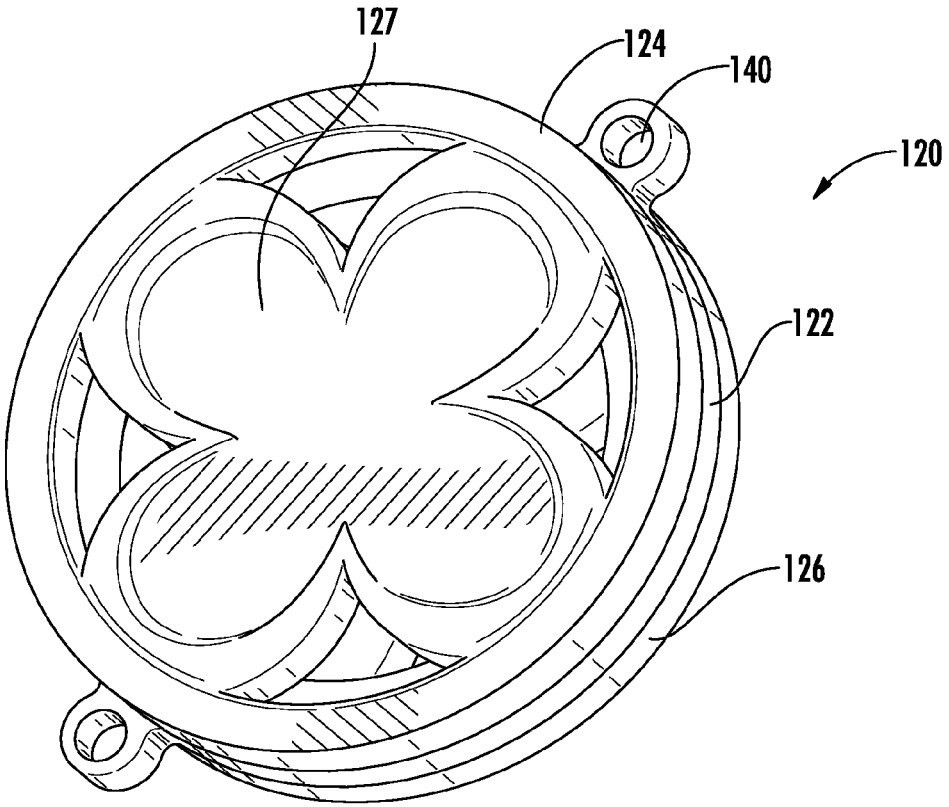
FIG. 5 is a perspective view of an alternate embodiment.
Figure 6:
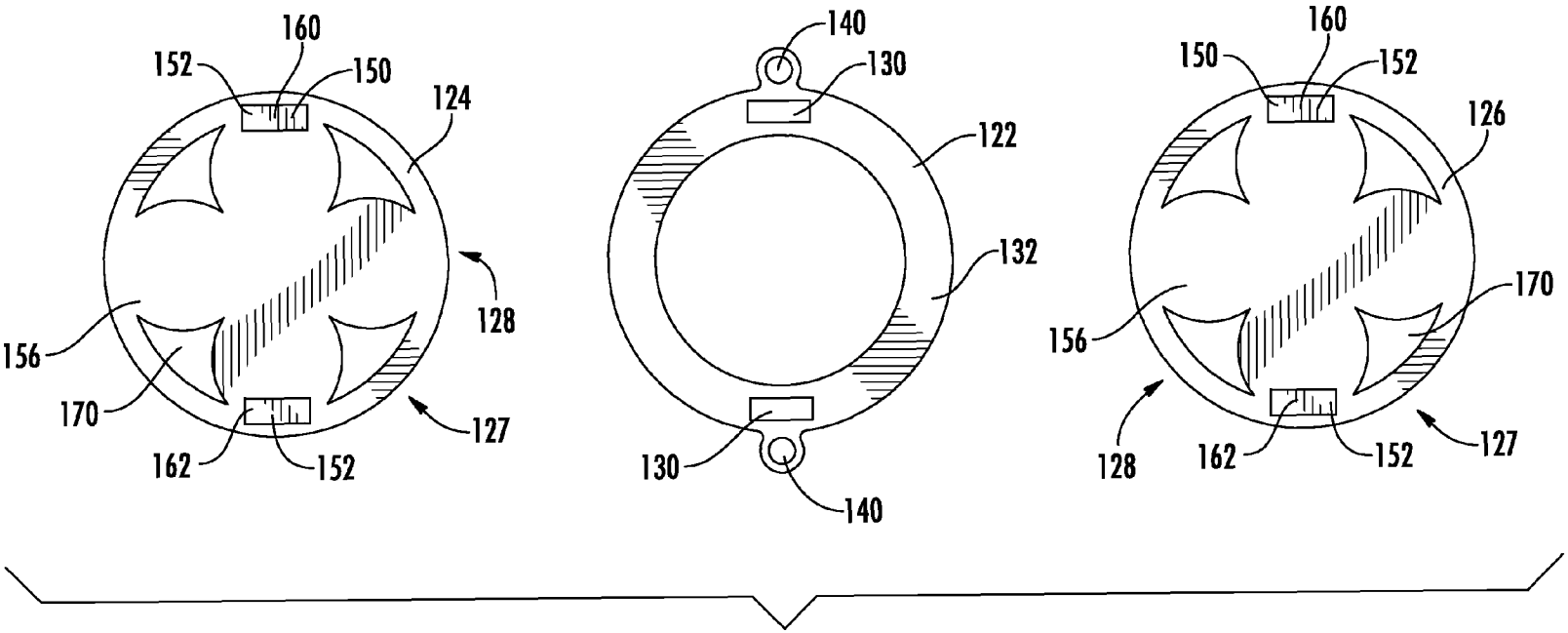
FIG. 6 is an exploded view of the alternate embodiment.

It is to be understood that there are variations available to the embodiment shown in FIGS. 1-4. Variations include but are not limited to size and shape, number of loops, number and placement of magnets, shape of magnets, number of recesses, shapes of recesses. The shapes of the recesses and magnets can also be circular. One such variation is shown in FIGS. 5-6 which detail a device 120. The numbering system utilized in FIGS. 5-6 is similar to that of FIGS. 1-4 as corresponding parts are given a prefix of "1" in FIGS. 5-6. For example, the coupling member in FIGS. 5-6 is part 122 where it is 22 in FIGS. 1-4. Accordingly, the second embodiment 120 has similar structures and works in the same way with the magnets 150 creating a force which positions a coupling member 122 in between a first body 124 and a second body 126. The primary difference in device 120 is that the design face 127 and first body 124 are manufactured as one piece. Additionally, the design face does not completely fill the area of the first body 124, therefore creating openings 170. The same applies to the design face 127 on the second body 126.

It is to be understood that any embodiment can be made of a variety of materials including silver and other precious metals, as well as thermoplastics and any other materials that would not affect the functionality of the invention.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. An interchangeable jewelry device, comprising:
a coupling member;
a first body;
a second body;
the first body attachable to the coupling member;
the second body attachable to the coupling member;
the first body comprising a first magnet and second magnet;
the second body comprising a third magnet and fourth magnet;
the coupling member positioned between the first and second body;
the first magnet attracted to the third magnet;
the second magnet attracted to the fourth magnet;
wherein a force generated by the magnets maintains the position of the coupling member;
the first body comprises a decorative element;
the second body comprises a decorative element;
the coupling member comprises a first hole and a second hole;
the first magnet at least partially contained in the first hole;
the second magnet at least partially contained in the second hole;
the third magnet at least partially contained in the first hole;
the fourth magnet at least partially contained in the second hole.

2. The interchangeably jewelry device of claim 1, wherein:
the coupling member comprises a first loop and a second loop;
the first loop is capable of receiving a chain of a necklace;
the second loop is capable of receiving a chain of a necklace.

3. The interchangeably jewelry device of claim 2, wherein:
the first hole is rectangular;
the second hole is rectangular.

4. The interchangeably jewelry device of claim 3, wherein:
the coupling member is made of a non-magnetic material.

5. The interchangeable jewelry device claim 4, wherein:
the coupling member is circular.

6. The interchangeable jewelry device of claim 5, wherein:
the first body is circular.

7. The interchangeable jewelry device of claim 6, wherein:
the first body has a first radius;
the coupling member has a second radius;
the first radius is equal to the second radius.

8. The interchangeable jewelry device of claim 3, wherein:
the coupling member is made of silver.

9. The interchangeable jewelry device of claim 8, wherein:
the coupling member is non-circular.

10. An interchangeable jewelry device, comprising:
a coupling member;
a first body;
a second body;
the first body attachable to the coupling member;
the second body attachable to the coupling member;
the first body comprising a first magnet and second magnet;
the second body comprising a third magnet and fourth magnet;
the coupling member positioned between the first and second body;
the first magnet attracted to the third magnet;
the second magnet attracted to the fourth magnet;
wherein a force generated by the magnets maintains the position of the coupling member;
the coupling member comprises a first hole and a second hole;
the first magnet at least partially contained in the first hole;
the second magnet at least partially contained in the second hole;
the third magnet at least partially contained in the first hole;
the fourth magnet at least partially contained in the second hole.

11. The interchangeably jewelry device of claim 10, wherein:
the coupling member comprises a first loop;
the first loop is capable of receiving a chain of a necklace.

12. The interchangeably jewelry device of claim 10, wherein:
the first hole is rectangular.

13. The interchangeably jewelry device of claim 10, wherein:
the coupling member is circular.

14. The interchangeably jewelry device of claim 13, wherein:
the first body is circular.

15. The interchangeably jewelry device of claim 14, wherein:
the first body has a first radius;
the coupling member has a second radius;
the first radius is equal to the second radius.

16. The interchangeably jewelry device of claim 10, wherein:
the coupling member is non-circular.

* * * * *